US006025810A

United States Patent [19]

Strom

[11] Patent Number: 6,025,810

[45] Date of Patent: Feb. 15, 2000

[54] HYPER-LIGHT-SPEED ANTENNA

[76] Inventor: David L. Strom, 1615 Geneva St., Aurora, Colo. 80010

[21] Appl. No.: 08/942,824

[22] Filed: Oct. 2, 1997

Related U.S. Application Data

[60] Provisional application No. 60/028,204, Oct. 2, 1996.

[51] Int. Cl.[7] ..... H01Q 1/32

[52] U.S. Cl. ..... 343/787; 343/711; 343/721; 343/895

[58] Field of Search ..... 343/711, 713, 343/721, 725, 787, 788, 895

[56] References Cited

U.S. PATENT DOCUMENTS 5,714,959 2/1998 Troy et al. ..... 343/713

*Primary Examiner*—Don Wong
*Assistant Examiner*—James Clinger
*Attorney, Agent, or Firm*—Rick Martin

[57] ABSTRACT

A method to transmit and receive electromagnetic waves which comprises generating opposing magnetic fields having a plane of maximum force running perpendicular to a longitudinal axis of the magnetic field; generating a heat source along an axis parallel to the longitudinal axis of the magnetic field; generating an accelerator parallel to and in close proximity to the heat source, thereby creating an input and output port; and generating a communications signal into the input and output port, thereby sending the signal at a speed faster than light.

30 Claims, 14 Drawing Sheets

Note: All units connected by dashed lines are pieces of 1 assembly. See FIG. 4.

SW1
FIG. 3 TS1-2
FIG. 3 TS1-3
CB1
1 AMP
CB2
10 AMP
FIG. 7 R27 & R28
FIG. 8 R42 & R43
470 uFD
200VDC
C3
BR1
FL1
Input Filter
N
L
Corcom
EMI Filter 6EF1F

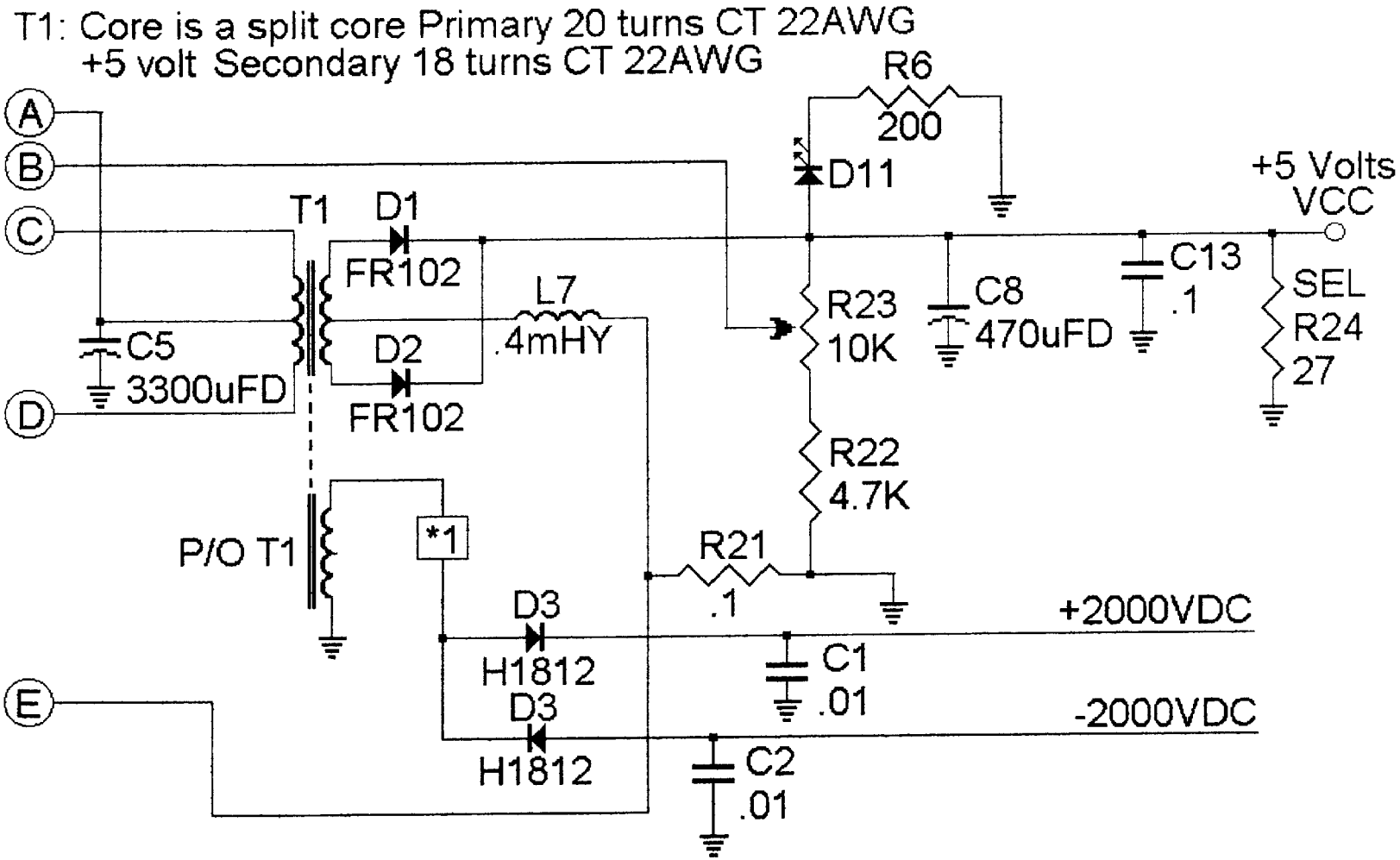
CONTINUATION OF FIG. 3
T1: Core is a split core Primary 20 turns CT 22AWG
+5 volt Secondary 18 turns CT 22AWG
+5 Volts
VCC
SEL
R24
27
C13
.1
C8
470uFD
R6
200
D11
R23
10K
R22
4.7K
R21
.1
C1
.01
C2
.01
+2000VDC
-2000VDC
L7
.4mHY
D1
FR102
D2
FR102
T1
C5
3300uFD
*1
P/O T1
D3
H1812
D3
H1812
A
B
C
D
E

FIG. 6

| REFERENCE NUMBER | FIG. NUMBER | PART DESCRIPTION | COMMENTS |
|---|---|---|---|
| BR1 | 2 | 10AMP 400V | BRIDGE RECT. |
| C 1 & C2 | 3 | .01uFD | 3KV |
| C3 | 2 | 470uFD | 200VDC |
| C4 | 7 | 470uFD | 200VDC |
| C5 | 3 | 3300uFD | 50V |
| C7 | 8 | 470uFD | 200VDC |
| C8 | 3 | 470uFD | 35V |
| C9 & C10 | 3 | .01 | 50V |
| C11 | 3 | 10ufD 25V | TANT. |
| C12 | 3 | .001 | 50V |
| C13 | 3 | .1 | 50V |
| C14 | 8 | 1uFD | 200VDC |
| CB1 | 5 | 1 AMP | |
| CB2 | 5 | 10AMP | |
| D1 & D2 | 3 | FR102 | |
| D3 & D4 | 3 | H1812 | VARO |
| D5 | 3 | 1N5404 | |
| D6 & D7 | 7 | 1N5404 | |
| D8 & D9 | 8 | 1N5404 | |
| D10 | 8 | MR918 | |
| FL1 | 2 | 6EF1F EMI FILTER CORCOM | |
| HS1 & HS2 | | HEAT SINK 6 TO3 | |
| HS3 | | HEAT SINK 2 TO220 (Q8 AND Q9) | |
| J1 | 1&4 | UG-1094/U | |
| L1 & L3 | 1 | 2500 TURNS | 22AWG |
| L2 | 1 | ¼ WAVE LENGTH OF OPERATING FREQ. | |
| L4 | 1 | 36AWG WRAPPED AROUND R5 | |
| L5 | 1 | 36AWG WRAPPED AROUND R5 | |
| L7 | 3 | .4mHY | |
| Q1, Q2, Q3, Q4, Q5 & Q6 | 8 | 2SD1185 | |
| Q7 | 8 | MJE13007 | |
| Q8 & Q9 | 3 | TIP32 | |
| Q10, Q11, Q12, Q13, Q14 | 7 | 2SD1185 | |
| Q15 | 7 | 2SD1185 | |
| Q16 | 7 | MJE13007 | |

| REFERENCE NUMBER | FIG. NUMBER | PART DESCRIPTION | COMMENTS |
|---|---|---|---|
| R1 | 7 | 10K | |
| R2 | 7 | 33K | |
| R3 | 7 | 470 OHM | 2WATT |
| R4 | 7 | 100 OHM | 2WATT |
| R5 | 1 | 620 WATT HALOGEN LAMP | |
| R7 & R8 | 7 | .47 OHM | 3WATT |
| R9 | 3 | 4.7K | |
| R10 | 3 | 220 OHM | 1/2WATT |
| R11 & R12 | 3 | 47 OHM | 1/2WATT |
| R13 | 3 | 10K | |
| R14 | 3 | 33K | |
| R15 | 3 | 1MEG | |
| R16 | 3 | 4.7K | |
| R17 & R18 | 7 | .47 OHM | 3WATT |
| R19 | 3 | 15K | |
| R20 | 3 | 4.7K | |
| R21 | 3 | .1 OHM | 1/2WATT |
| R22 | 3 | 4.7K | |
| R23 | 3 | 10K MULTI. TURN POT. | |
| R24 | 3 | 27 OHM | 3WATT |
| R25 | 7 | .47 OHM | 3WATT |
| R26 | 7 | 100K | POT. |
| R27, R28, R29 & R30 | 7 | 10 OHM | 25WATT |
| R31 | 8 | 10K | |
| R32 | 8 | 100K | POT. |
| R33 | 8 | 33K | |
| R34 | 8 | 470 OHM | 2WATT |
| R35 | 8 | 100 OHM | 2WATT |
| R37, R38, R39, R40 & R41 | 8 | .47OHM | 3WATT |
| R42, R43, R44 & R45 | 8 | 10 OHM | 25WATT |
| S1 | 2 | DPST | 10AMP |
| T1 | 3 | 2892994-00 | UNISYS P/N |
| T2 | 3 | 1905C31H01 | HAMMOND P/N |
| TS1 | 3 | 4 TERMINAL | TERMINAL STRIP |
| TS2, TS3, TS4, TS5, TS6 and TS7 | | 5 TERMINAL | TERMINAL STRIP |
| U1 | 3 | TL494 | |

ALL RESISTORS ¼ WATT UNLESS OTHERWISE SPECIFIED

Q1 2SD1185
Q2 2SD1185
Q3 2SD1185
Q4 2SD1185
Q5 2SD1185
R37 .47
R38 .47
R39 .47
R40 .47
R41 .47
R36 3.3K
D9 1N5404
Q6 2SD1185
R35 100
Q7 MJE13007
R34 470
D8 1N5404
R33 33K
R32 100K
R31 10K
PART OF PS1
FIG. 5 L1
D10 MR918
C14 1uFD
C7 470uFD
R44 10
R45 10
R42 10
R43 10
C6 470uFD
FIG. 2 BR1

FIG. 12

| Reference Number | FIG. Number | Part Description | Comments |
|---|---|---|---|
| CF1 | 9 | Coil Form | Construction Info. Fig. 9 |
| CF2 | 10 | Coil Form | Construction Info. Fig. 10 |
| CF3 | 9 | Coil form | Same as CF1 |
| 10 | 11 | Right support plate | HPII R/H Fixer bracket |
| A1 | | Leaf Housing | |
| SP1 | | Left support plate | HPII L/H Fixer bracket |
| SP2 | | Spring | HPII Lamp support spring |

HYPER-LIGHT-SPEED ANTENNA

CROSS-REFERENCE TO RELATED APPLICATION

This application is a non-provisional application claiming the benefits of provisional application No. 60/028,204 filed Oct. 2, 1996.

FIELD OF INVENTION

The present invention relates to a new type of antenna for transmission and reception of RF signals. The present invention can be used to replace conventional antennas. It is believed that this invention can transmit energy at a faster speed and over a greater distance than conventional antennas with the same power.

BACKGROUND OF THE INVENTION

All known radio transmissions use known models of time and space dimensions for sending the RF signal.

The present invention has discovered the apparent existence of a new dimension capable of acting as a medium for RE signals. Initial benefits of penetrating this new dimension include sending RF signals faster than the speed of light, extending the effective distance of RF transmitters at the same power radiated, penetrating known RF shielding devices, and accelerating plant growth exposed to the by-product energy of the RF transmissions.

The following describes, in simple terms, what the present invention actually does. The present invention takes a transmission of energy, and instead of sending it through normal time and space, it pokes a small hole into another dimension, thus, sending the energy through a place which allows transmission of energy to exceed the speed of light.

The following is a description of how the communications medium converter functions.

First, you need to create a hot surface that is more than 1000 degrees Fahrenheit. Next, it requires a strong magnetic field. Then, you need an accelerator, followed by an electromagnetic injection point. For communications or data communication, you need 2 devices. Each device is connected to a transmitter and receiver. This allows electromagnetic energy to enter a dimension and to travel at speeds faster than the speed of light.

The magnetic fields are focused onto the heat generating device. The electromagnetic injection point is the plane generated by the two opposing magnetic fields.

It has been observed by the inventor and witnesses that accelerated plant growth can occur using the present invention.

For accelerated plant growth, first, you need to create a hot surface that is more than 1000 degrees Fahrenheit. Next, you need a strong magnetic field. Only one device is needed for this function. This allows energy from another dimension to influence plant growth.

SUMMARY OF THE INVENTION

The main aspect of the present invention is to send RF signals faster than the speed of light.

Other aspects of this invention will appear from the following description and appended claims, reference being made to the accompanying drawings forming a part of this specification wherein like reference characters designate corresponding parts in the several views.

The preferred embodiment is an additional piece of equipment that connects to an existing communications device in place of its original antenna. This device changes the medium of transmission and reception of electromagnetic waves. This allows the transmission and reception of electromagnetic radio signals to exceed the speed of light.

The main purpose of this device is:

1. To allow signals to travel great distances at many times the speed of light.

2. To use considerably less power to travel the same distance, compared to transmitters not using this device.

A. There are several pieces that make it work.

B. The following four things (numbered 1)–4) below) must occur for this unit to function efficiently.

1) There must be a heat source that produces more than 1000 degrees Fahrenheit.
   a) This heat source may or may not be in a sealed assembly.

2) There must be at least one magnetic field. This unit uses two opposing magnetic fields.
   a) These fields may be produced by electromagnets or by permanent magnets. This can be done with just one magnetic field, but it would be harder to find the penetration point. Consequently, it is harder to find where to inject the electromagnetic radio signal. The strength of the magnetic field is variable, the closer to the heat source, the lower the magnetism can be.

3) There must be at least one accelerator. This unit uses two accelerators.
   a) These accelerators may be linear or circular in polarization.
   b) These accelerators need to be close to the heat source and near to the junction of the opposing magnetic fields and close to the penetration point.
   c) This unit can use one accelerator, but is more efficient with two.

4) There must be a way to insert the electromagnetic signal which is the electromagnetic injection point. Digital data can also be sent through this device.
   a) The electromagnetic signal is inserted at the junction of the two opposing magnetic fields or at the penetration point, if you are using just one magnetic field.

The following is a description of how the preferred embodiment known as the Hyper-Light-Speed Antenna is constructed.

1. R5 is a 620-watt Halogen pencil lamp approximately 12 inches long with a diameter of approximately 0.3 inches. Power to the lamp is supplied at the ends of the lamp.
2. The accelerators are a thin piece of wire wrapped around the glass lamp. (This is for circular polarization). For linear polarization, two thin pieces of wire are attached to the lamp. One wire runs down one side of the lamp, the other wire runs down the other side of the lamp (180 degrees from each other). The spacing is not critical but must have enough spacing to prevent arcing between the accelerators. The accelerators operate at +2000 V DC on one accelerator and −2000 V DC on the other.
3. This assembly goes inside a tube approximately 10.3 inches long_this length is not critical. Diameter of the tube is approximately 1.1 inches.
4. Heat insulating material is installed on the tube.

5. Coil forms are installed on the tube, the forms CF1 and CF3 are 4.3 inches long. These forms are then wound with 2500 turns of 22 AWG wire.
6. The coils are wired so both Magnetic Norths are toward the center of the tube. (The unit can be set so both Magnetic Souths are toward the center.)
7. In the middle of the tube there is 0.4 inches for the magnetic injection assembly L2.

BRIEF DESCRIPTION OF THE DRAWINGS

FIG. 6 is a partial parts list for the current invention.

FIG. 12 is a continuation of the parts list of FIG. 6.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

The current invention functions like an antenna that can replace an existing antenna on a transmitter or receiver. The current invention changes the medium of transmission and reception of electromagnetic waves such that information is transmitted at greater than the speed of light.

Figure 1:
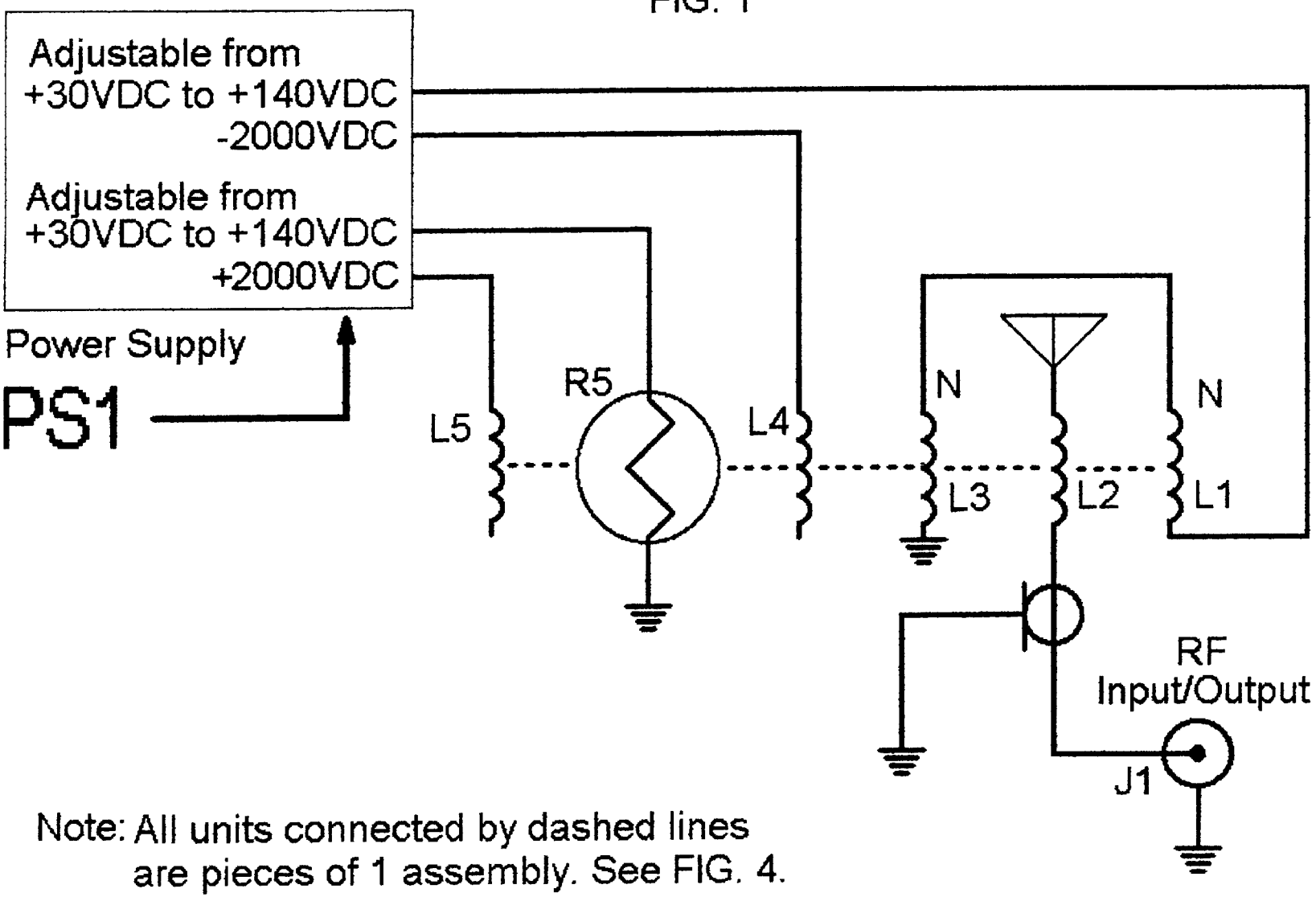
FIG. 1 is a schematic of the current invention.

FIG. 1 illustrates the general layout of the preferred embodiment of the invention. The invention is an antenna that, it is believed, can transmit or receive information at a speed greater than the speed of light. L1 and L3 are electromagnets which create two opposing magnetic fields. A heater R5 consisting of a 620-watt Halogen lamp is used to raise the temperature to 1000° F.

Two accelerators L4 and L5 are biased at ±2000 V DC. The accelerators are wires wrapped around the glass heater R5.

The intersection of the opposing magnetic fields created by electromagnets L1 and L3 form an electromagnetic injection point.

The magnetic injection assembly L2 is a one-quarter or three-quarter wavelength coil antenna placed at the electromagnetic injection point. J1 is a BNC connector for the insertion of the RF signal if the device is a transmitter or for the extraction if the RF signal of the device is a receiver.

The power supply PS1 supplies the +30 V DC to +140 V DC to supply the electromagnets L1 and L3 and the heater R5. The power supply also supplies the +2000 V DC and −2000 V DC bias voltages for accelerators L4 and L5.

Figure 2:
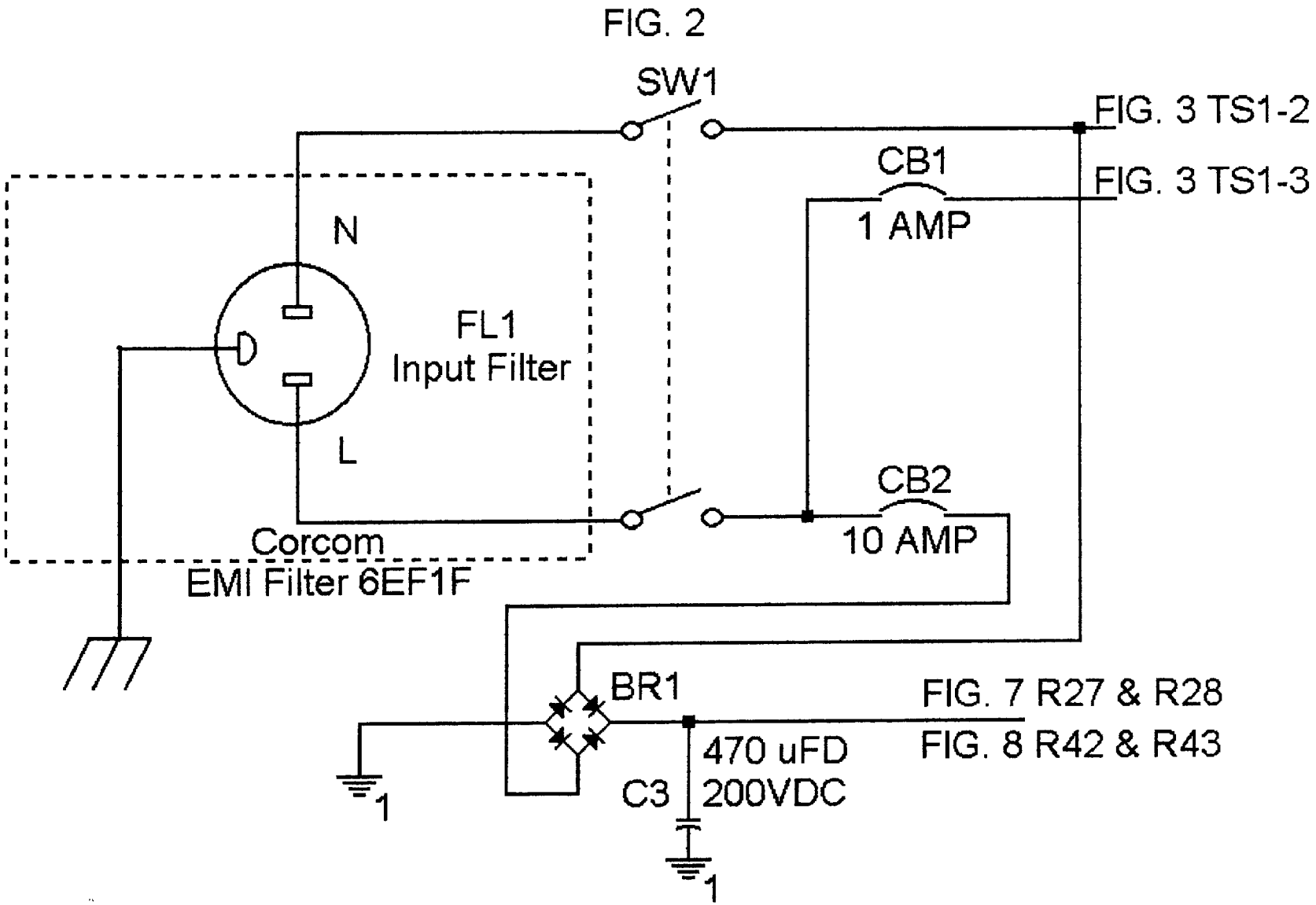
FIG. 2 is a schematic of the power entry and rectifier circuitry.

FIG. 2 is the input filter and regulator circuitry for the power supply PS1. FL1 is a power entry module which uses a common PC-style power cord. FL1 has an EM1 filter built into it.

SW1 is a double pole single throw switch which turns power to the device on and off. Circuit breaker CB1 and CB2 are installed for protection in the event of a circuit failure. Rectifier BR1 and capacitor C3 generate an unregulated DC voltage for use in the circuitry on FIG. 7 and 8. The AC voltage from SW1 is used on the circuitry of FIG. 3.

Figure 3:
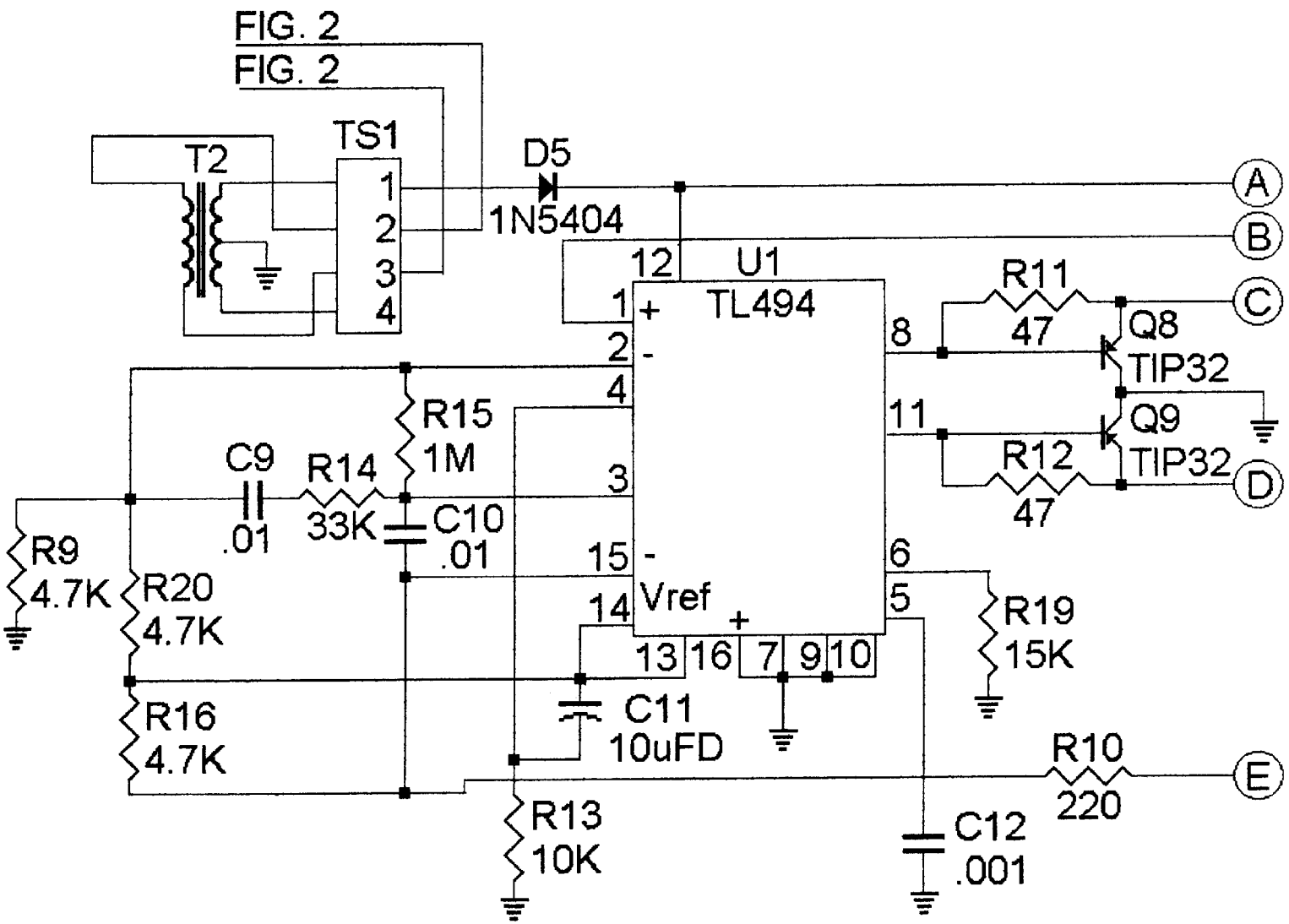
FIG. 3 is a schematic of the 5 V DC and the ±2000 V DC power supply.

FIG. 3 is the power supply PS1. The signals TS1-2 and TS1-3 from FIG. 2 go to terminal strip TSI and supply transformer T2. Diode D5 rectifies the output of transformer T2 and generates an unregulated +34 V DC. Capacitor C5 is used to filter some of the ripple from the +34 V DC. The fixed frequency pulse width modulated control circuit U1 is used to control the switching regulator power supply PSI. Power supply PS1 produces +5 V DC VCC, +2000 V DC, and −2000 V DC.

T1 is a split core, open frame flyback transformer. The Primary is hand wound on the side of the flyback that has no existing windings. The primary is 20 turns center tapped using 22 AWG magnet wire. The +5 volt secondary is wound on the same side the primary is wound. This winding is 18 turns center tapped using 22 AWG magnet wire. (T1 can be almost any open frame split core flyback transformer, which was designed for about 10,000 volts with an external high-voltage diode).

C11 and R13 provides a soft start to the power supply PS1. R19 and C12 sets the oscillator frequency at approximately 80 KHz. R14, R15, C9, and C10 provide feedback to pin 3 of U1. R10, R16, and R21 provides current limit for the +5 V DC output.

Q8 and Q9 drive the primary winding of transformer T1 to produce the output voltages, R11 provides bias to keep Q8 turned off, and R12 provides bias to keep Q9 turned off until U1 sends a varying pulse width to drive Q8 and Q9. Pin 4 of U1 provides a +5-volt reference voltage, R9 and R20 is a voltage divider that provides a 2.5-volt reference to pin 2 of U1. When the voltage is lower than 2.5 volts on pin 1 of U1 the pulse width is increased at U1 pin 8 and U1 pin 11, when the voltage is higher than 2.5 volts on pin 1 of U1, then the pulse width is decreased at U1 pin 8 and U1 pin 11. R22 and R23 is a voltage divider which divides the +5 volts to approximately 2.5 volts. R22 sets the upper limit of the +5 volts. The potentiometer R23 adjusts the +5 volts. The voltage at the wiper of R23 is compared to pin 2 of U1. D1 and D2 full wave rectifies the +5 volts, C8 and C13 filters the +5 volts. The +5 volts drives D11 which is a light-emitting diode, R6 limits the current through D11. D11 lights when high voltage is being produced.

D3 and D4 connect to the high-voltage winding of T1, D3 rectifies and produces the +2000 volts DC, C1 filters the +2000 volts, and C2 filters the −2000 V DC. R24 is selected to adjust the plus and minus 2000 volts.

Figure 7:
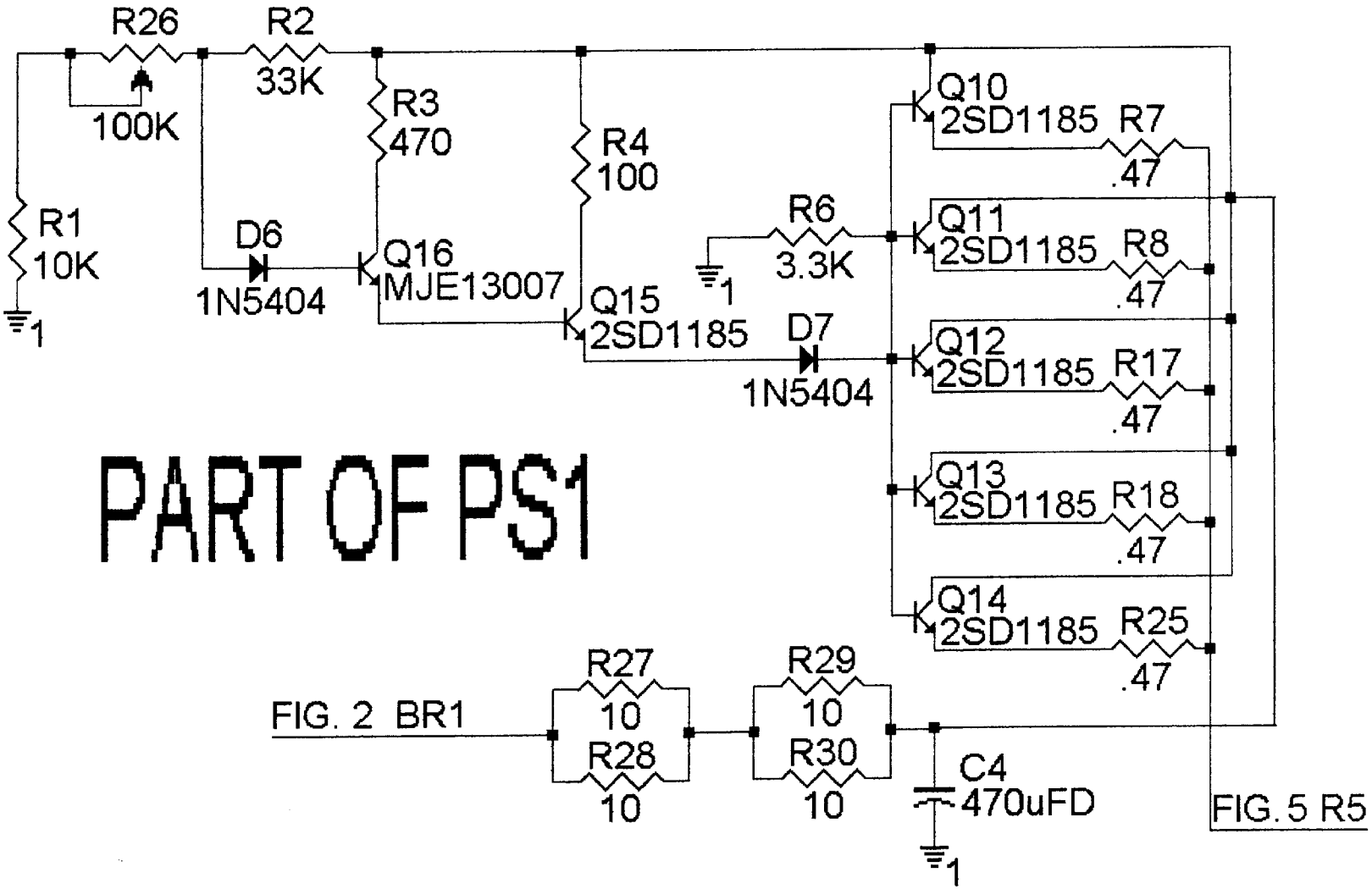
FIG. 7 is a schematic of the heater power supply for R5.

The voltage from rectifier BR1 FIG. 2 is used in FIG. 7 to generate the voltage to drive R5 in FIG. 1. Resistors R27, R28, R29, R30, R2, R1 and potentiometer R26 provide a voltage divider to ultimately set the voltage on heater R5. Capacitor C4 provides additional filtering to the voltage on heater R5. The divider output voltage on the anode of diode D6 is stepped down by the diode drops of diodes D6 and D7 and emitter followers Q16 and Q15 to drive the five parallel emitter followers Q10, Q11, Q12, Q13, Q14. The emitter follower Q10–Q14 output currents are balanced by resistors R7, R8, R17, R18, R25 and drive the heater R5.

Figure 8:
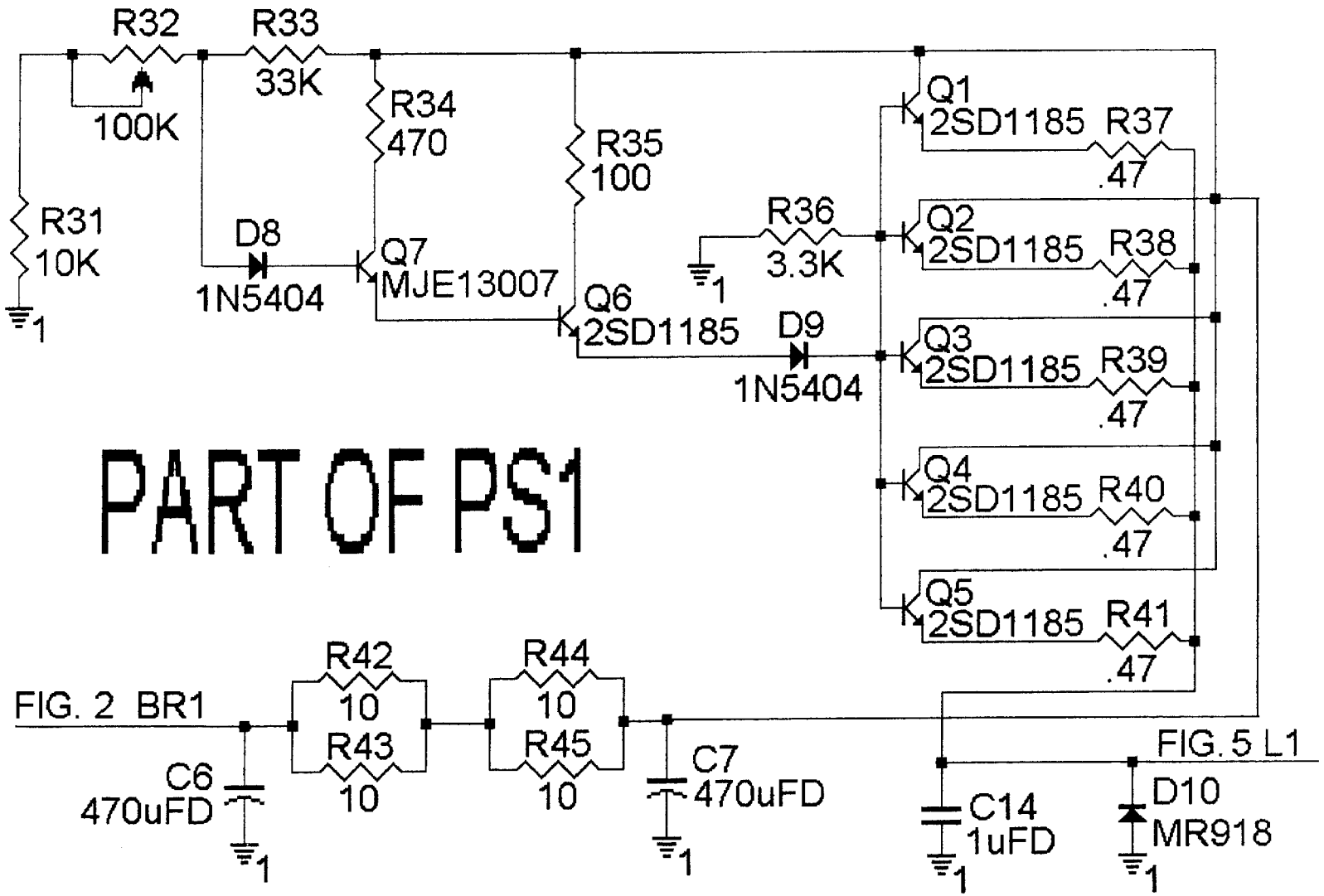
FIG. 8 is a schematic of the electromagnet power supply.

The voltage from rectifier BR1 FIG. 2 is used in FIG. 8 to generate the voltage to drive the electromagnets L1 and L3 FIG. 1. Resistors R42, R43, R44, R45, R33, R31 and potentiometer R32 provide a voltage divider to ultimately set the voltage on electromagnets L1 and L3. Capacitor C7 and C14 provides additional filtering to the voltage on electromagnets L11, L3. The divider output voltage on the anode of diode D8 is stepped down by the diode drops of diodes D8 and D9 and emitter followers Q7 and Q6 to drive the five parallel emitter followers Q1, Q2, Q3, Q4, Q5. The emitter follower Q1–Q5 output currents are balanced by resistors R37, R38, R39, R40, R41 and drive the electromagnets L1 and L3.

The diode D10 is used to suppress the inductive kick from electromagnets L1 and L3 when the device is shut down.

Figure 4:
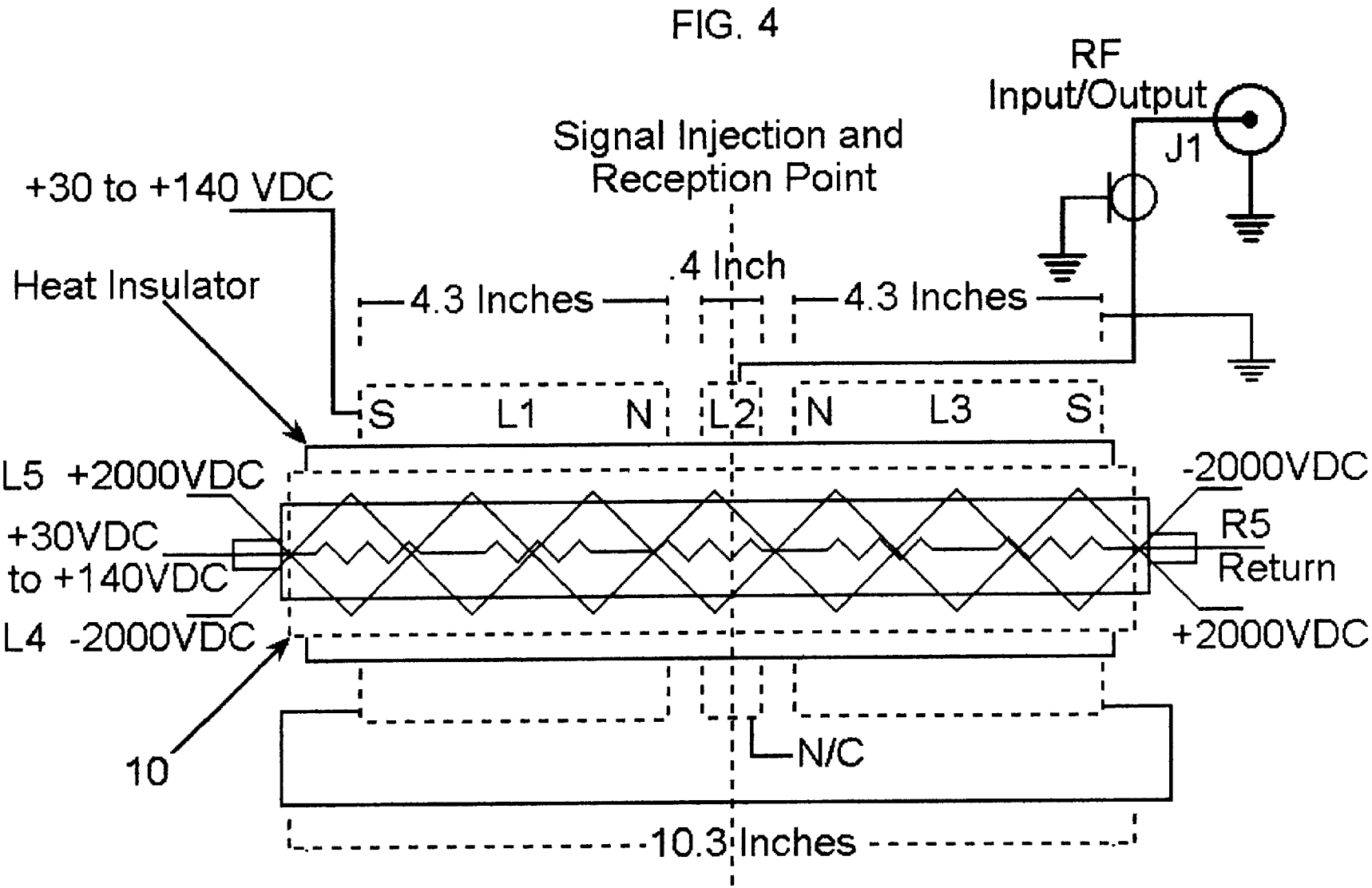
FIG. 4 is an assembly drawing of the inductor housing.

FIG. 4 is a more detailed mechanical depiction of the present invention. Heater R5 is a 620 watt Halogen pencil lamp approximately 12 inches long with a diameter of approximately 0.3 inches. Power is supplied at the ends of the lamp A, B.

Accelerators L4, L5 are thin wires wrapped around the heater R5 for circular polarization. For linear polarization, accelerators L4 and L5 are placed along the lamp 180° apart. The spacing between accelerators L4 and L5 are not critical but must be enough space to prevent arcing between the accelerators L4, L5. The accelerators L4, L5 operate at +2000 V DC on L5 and −2000 V DC on L4.

The heater R5 is placed inside of inductor housing 10 approximately 10.3 inches long and 1.1 inches in diameter. Heat insulating material HI is installed on the inductor housing 10.

Coils are wound on forms to form electromagnets L1, L3. The electromagnets L1, L3 are wound with 2500 turns of 22 AWG wire. The electromagnets L1, L3 are placed on the inductor housing 10 so that both magnetic norths are toward the center of the inductor housing 10. The electromagnets L1, L3 are separated by 0.4 inches for the magnetic injection assembly L2. Connector J1 provides an electrical connection to the magnetic injection assembly L2.

Figure 5:
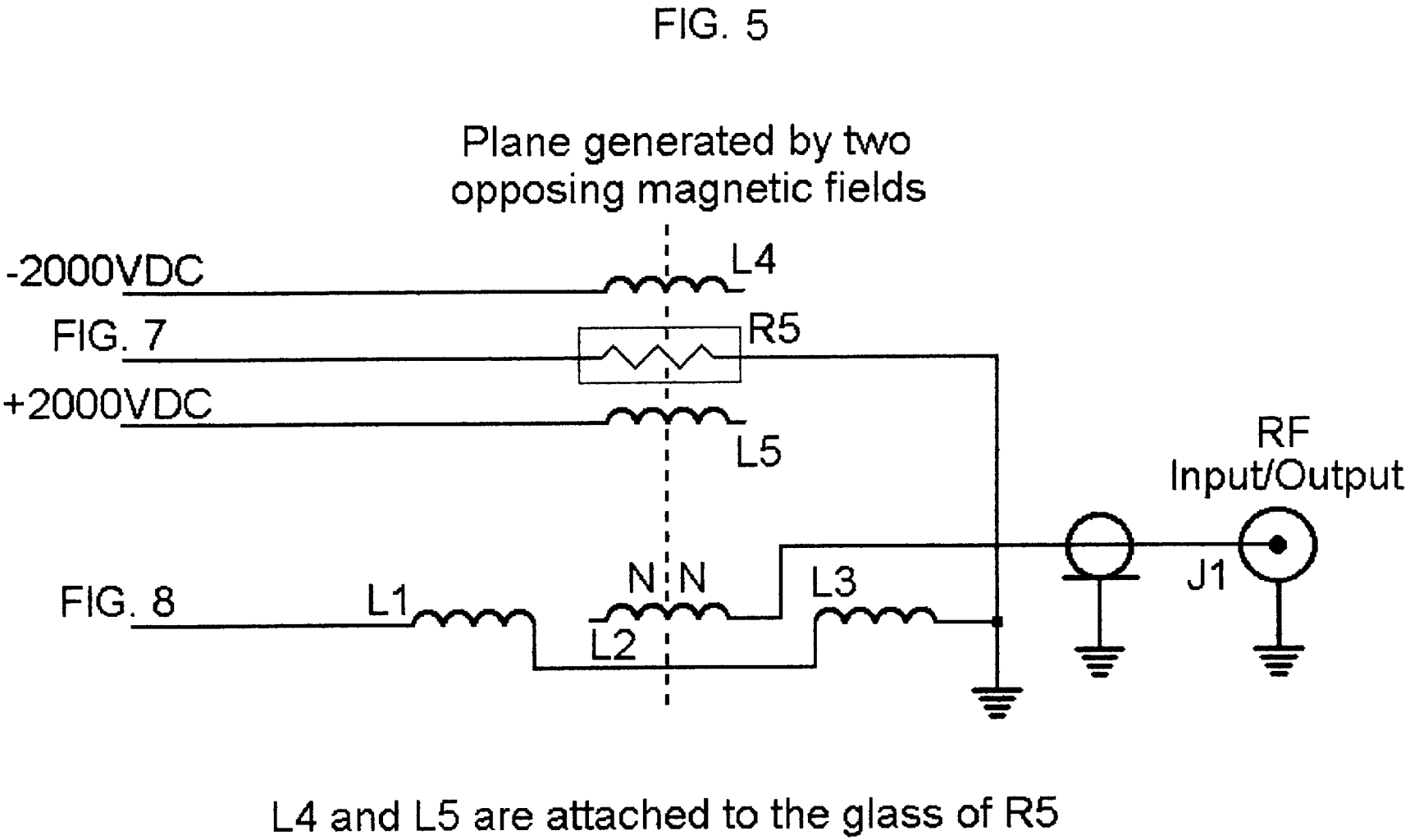
FIG. 5 is a schematic of the inductor housing.

FIG. 5 further illustrates the electrical relationship between the heater R5, the accelerators L4 and L5, and the electromagnets L1, L3.

Figure 11:
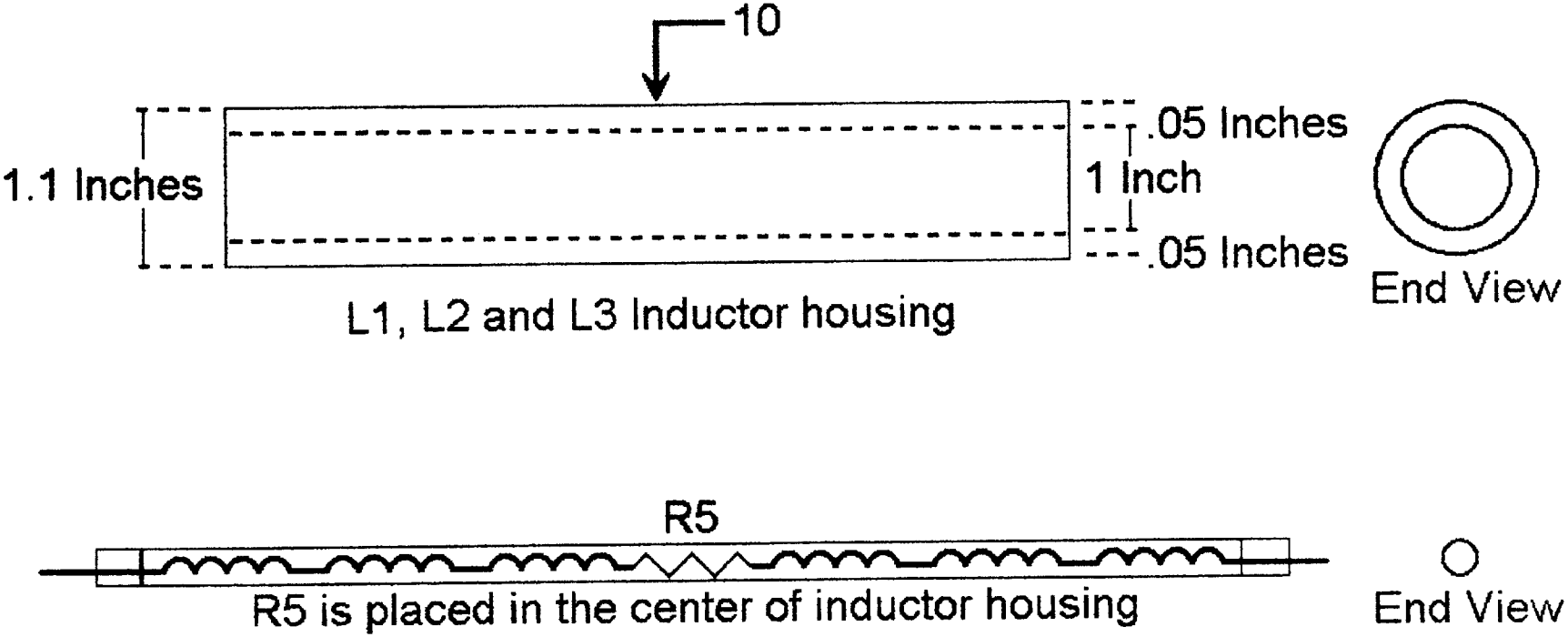
FIG. 11 is a side and end plane view of the inductor housing and heater.

FIG. 11 shows the mechanical dimensions of the inductor housing 10 and the heater R5.

Figure 9:
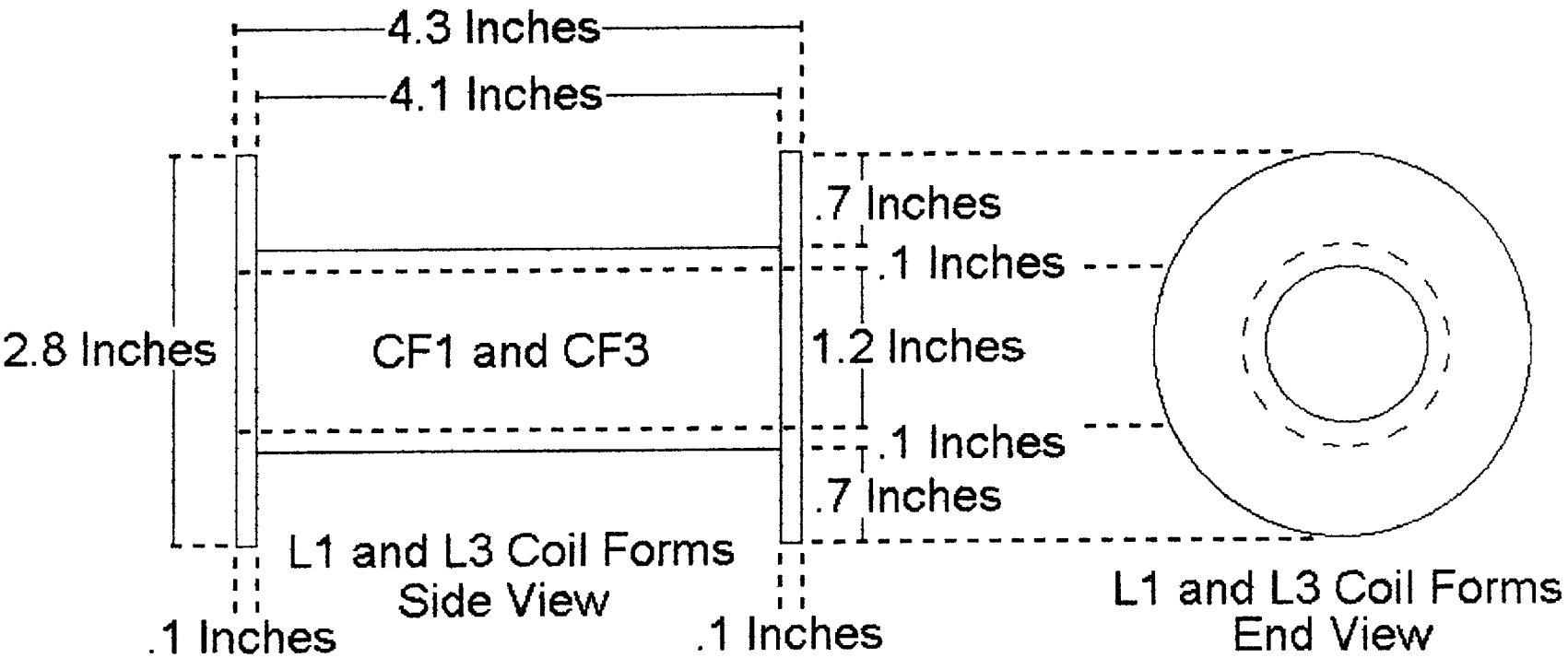
FIG. 9 is a side and end plane view of the electromagnet coil form.

FIG. 9 is the mechanical dimensions of the coil form CF1 and CF3 for the electromagnets L1, L3. The coil forms CF1 and CF3 are wound with 2500 turns of 22 AWG wire to from electromagnets L1, L3.

Figure 10:
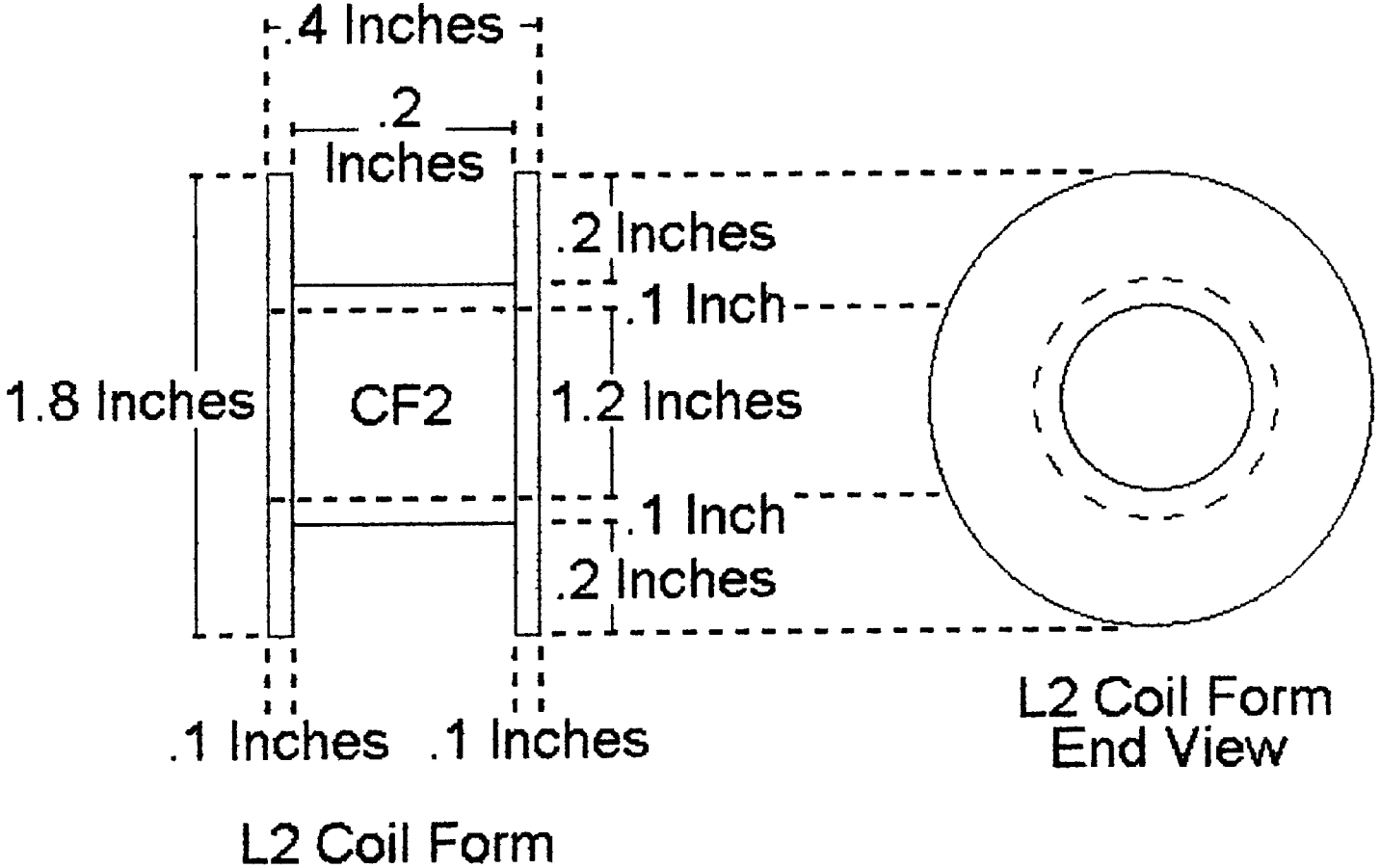
FIG. 10 is a side and end plane view of the magnetic injection assembly coil form.

FIG. 10 is the mechanical dimensions of the coil from CF2 for the magnetic injection assembly L2.

FIGS. 6 and 12 are a parts list for the current invention. The invention has been built as a prototype and testing is in progress.

Figure 13:
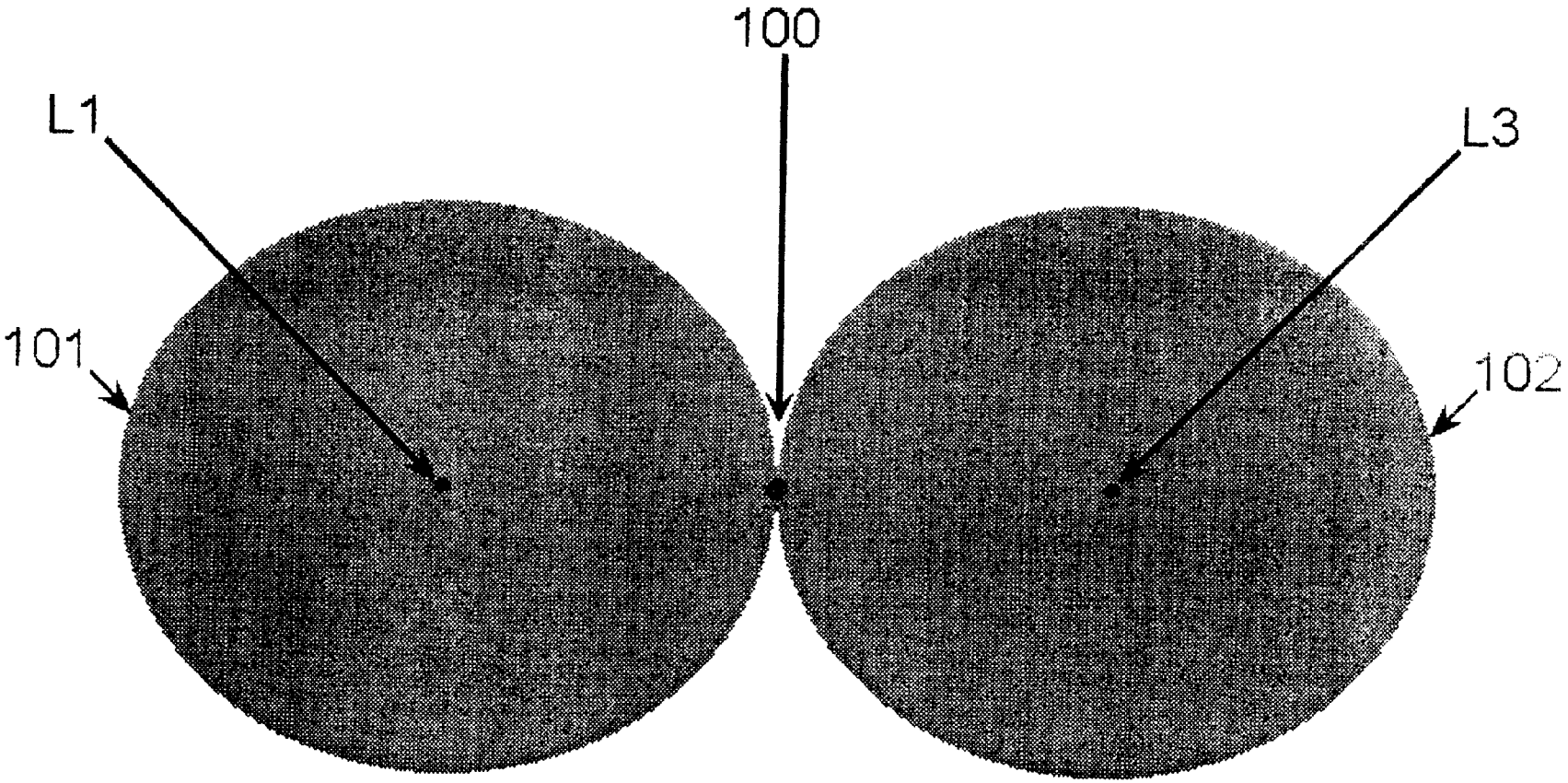
FIG. 13 is a schematic view of the electromagnets and their generated magnetic fields.

FIG. 13 shows electromagnet L1 which generates a first magnetic field 101. Electromagnet L3 generates a second magnetic field 102. The intersection of first magnetic field 101 and second magnetic field 102 forms electromagnetic injection point 100.

Although the present invention has been described with reference to preferred embodiments, numerous modifications and variations can be made and still the result will come within the scope of the invention. No limitation with respect to the specific embodiments disclosed herein is intended or should be inferred.

| GLOSSARY | |
|---|---|
| L1. | Electromagnet |
| L2. | Electromagnetic injection assembly |
| L3. | Electromagnet |
| L4. | Accelerator |
| L5. | Accelerator |
| R5. | Heater |
| J1. | BNC connector |
| PS1. | Power supply |

I claim:

1. A method to transmit and receive electromagnetic waves comprising:

generating opposing magnetic fields each having a plane of maximum force running perpendicular to a longitudinal axis of the respective magnetic field;

generating heat from a heat source along an axis parallel to the longitudinal axis of the magnetic field;

generating an accelerator parallel to and in close proximity to the heat source, thereby creating an electromagnetic injection point; and generating a communication signal into the electromagnetic injection point, thereby sending and receiving the communication signal at a speed faster than a known speed of light.

2. The method of claim 1, wherein said magnetic fields are generated by electromagnets.

3. The method of claim 1, wherein said magnetic fields are generated by permanent magnets.

4. The method of claim 2, wherein said electromagnets are wound with 2500 turns of 22 AWG wire.

5. The method of claim 1, wherein the temperature of said heat source is at least 1000 degrees Fahrenheit.

6. The method of claim 1, wherein said heat source further comprises a 620-watt Halogen lamp.

7. The method of claim 1, wherein said accelerator is linear in polarization.

8. The method of claim 1, wherein said accelerator is circular in polarization.

9. The method of claim 1, wherein said communications signal is generated by a magnetic injection assembly and a BNC connector.

10. The method of claim 9, wherein said magnetic injection assembly further comprises a one-quarter wavelength coil antenna.

11. The method of claim 9, wherein said magnetic injection assembly further comprises a three-quarter wavelength coil antenna.

12. The method of claim 1, wherein said accelerator is wrapped around said heat source.

13. An improved antenna comprising:

a heat source;

at least one magnetic field source in close proximity with said heat source;

an electromagnetic injection point formed in close proximity to said magnetic field source;

at least one accelerator in close proximity with said heat source; and an electromagnetic signal inserter placed at said electromagnetic injection point whereby a communication signal may be generated through said signal inserter, thereby sending the signal at a speed faster than light.

14. The improved antenna of claim 13, wherein the temperature of said heat source is at least 1000 degrees Fahrenheit.

15. The improved antenna of claim 13, wherein said magnetic field source further comprises an electromagnet or permanent magnet.

16. The improved antenna of claim 13, wherein said accelerator is linear or circular in polarization.

17. The improved antenna of claim 13, wherein said electromagnetic signal inserter further comprises a magnetic injection assembly and a BNC connector.

18. An improved antenna comprising:

a heat source;

first and second electromagnets in close proximity with said heater, said first and second electromagnets each creating an opposing magnetic field;

an electromagnetic injection point formed at the intersection of said opposing magnetic fields;

first and second accelerators in close proximity with said heat source; and an electromagnetic signal inserter placed at said electromagnetic injection point whereby a communication signal may be generated through said signal inserter, thereby sending the signal at a speed faster than light.

19. The improved antenna of claim 18, wherein said heater further comprises a 620-watt Halogen lamp.

20. The improved antenna of claim 18, wherein the temperature of said heat source is at least 1000 degrees Fahrenheit.

21. The improved antenna of claim 18, wherein said first accelerator is biased at +2000 V DC and said second accelerator is biased at −2000 V DC.

22. The improved antenna of claim 18, wherein said first and second accelerators are wrapped around said heat source.

23. The improved antenna of claim 18, wherein said electromagnetic signal inserter further comprises a magnetic injection assembly and a BNC connector.

24. The improved antenna of claim 23, wherein said magnetic injection assembly further comprises a one-quarter or three-quarter wavelength coil antenna.

25. An improved antenna comprising:

a 620 watt Halogen pencil lamp;

first and second thin wires attached to said lamp, said first thin wire biased at +2000 V DC, said second thin wire biased at −2000 V DC;

an inductor housing enveloping said lamp;

first and second electromagnets attached to said inductor housing, said electromagnets oriented such that both magnetic norths are disposed toward the center of said inductor housing;

a magnetic injection assembly disposed between said electromagnets; and a BNC connector in serial connection with said magnetic injection assembly.

26. The improved antenna of claim 25, wherein said thin wires are wrapped around said lamp for circular polarization.

27. The improved antenna of claim 25, wherein said thin wires are placed 180° apart along said lamp for linear polarization.

28. The improved antenna of claim 25, wherein said inductor housing is thermally insulated.

29. The improved antenna of claim 25, wherein said electromagnets are wound with 2500 turns of 22 AWG wire.

30. A method to transmit and receive electromagnetic waves comprising:

generating opposing magnetic fields each having a plane of maximum force running perpendicular to a longitudinal axis of the respective magnetic field;

generating heat from a heat source along an axis parallel to the longitudinal axis of the magnetic field;

generating an accelerator parallel to and in close proximity to the heat source, thereby creating an electromagnetic injection point;

generating a communication signal into the electromagnetic injection point; and receiving said communication signal as transmitted from said electromagnetic injection point.

* * * * *